US005531235A

United States Patent [19]

Hassenboehler, Jr.

[11] Patent Number: 5,531,235

[45] Date of Patent: Jul. 2, 1996

[54] CIGARETTE FILTER MICROPLEATED WEB AND METHOD OF MANUFACTURE

[76] Inventor: Charles B. Hassenboehler, Jr., 1806 Mansfield, Knoxville, Tenn. 37918

[21] Appl. No.: 952,059

[22] Filed: Sep. 28, 1992

[51] Int. Cl.[6] ..... A24D 3/16

[52] U.S. Cl. ..... 131/332

[58] Field of Search ..... 131/336, 335, 131/332

[56] References Cited

U.S. PATENT DOCUMENTS 3,346,682 10/1967 Thomson .
3,595,245 7/1971 Buntin ..... 131/269
3,704,192 11/1972 Soehngen et al. .
3,888,610 6/1975 Brackmann et al. .
3,978,185 8/1976 Buntin et al. .
4,059,121 11/1977 Brackmann et al. .
4,088,731 5/1978 Groome .
4,579,130 4/1986 Coffman .
4,818,463 4/1989 Buehning .

*Primary Examiner*—V. Millin
*Assistant Examiner*—William M. Pierce
*Attorney, Agent, or Firm*—Robert Graham

[57] ABSTRACT

A meltblown pleated web suitable for manufacturing cigarette filters or filter rods is prepared by drawing a meltblown web having longitudinal bend lines under thermal conditions to impart micropleats along the bend lines. Preferably the drawn and heated and pleated web is passed through an electric field to impart an electrostatic charge to its fibers.

18 Claims, 5 Drawing Sheets

FIG. 1
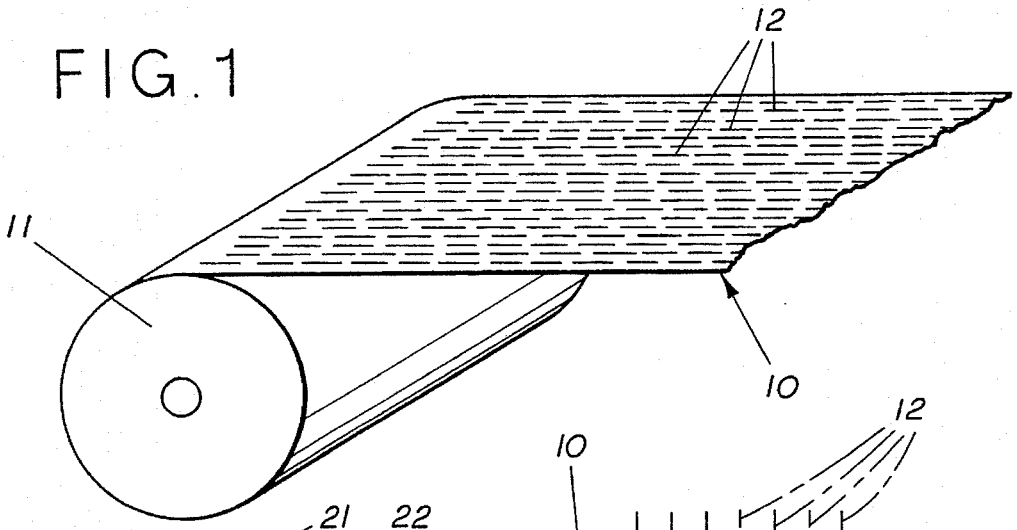
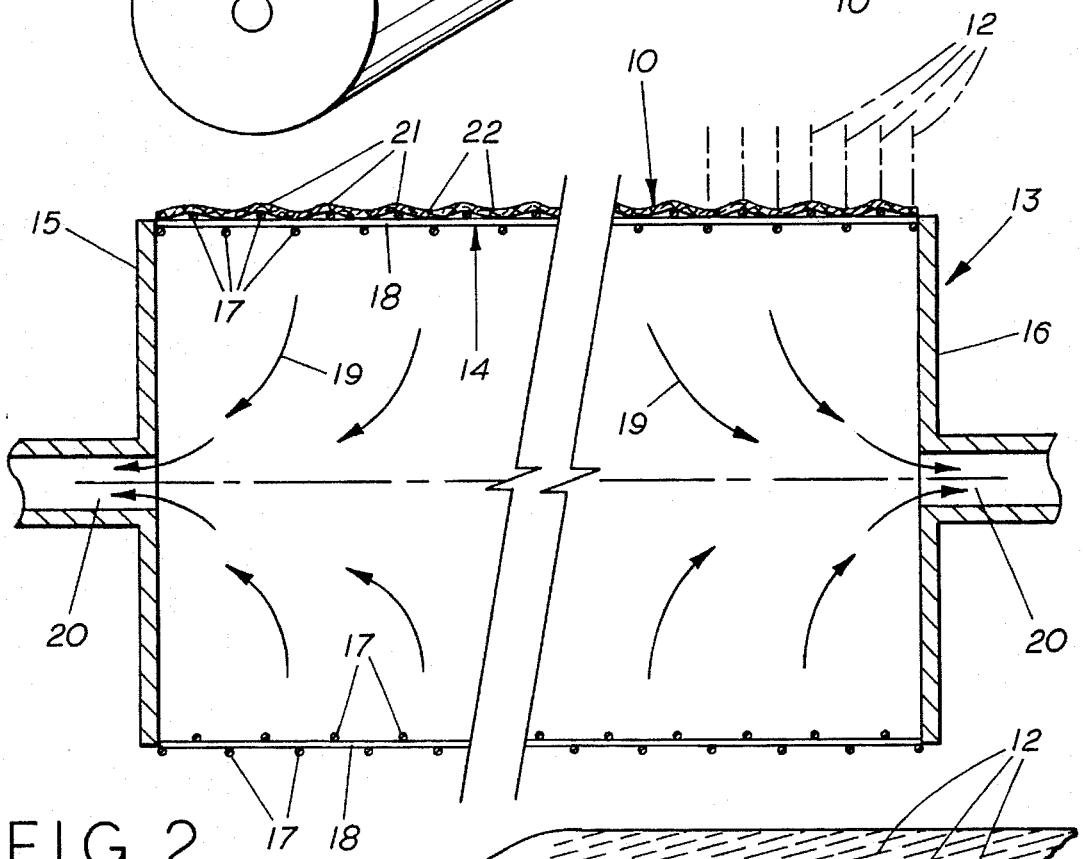
FIG. 2
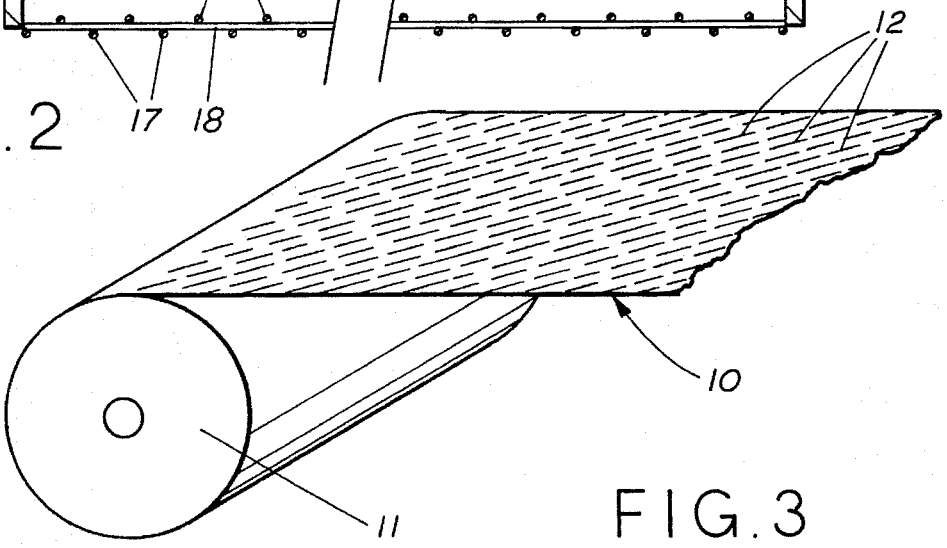
FIG. 3

CIGARETTE FILTER MICROPLEATED WEB AND METHOD OF MANUFACTURE

FIELD OF INVENTION

The present invention relates generally to cigarette filters made from thermoplastics, especially polyolefins. In one aspect the invention relates to cigarette filters made from meltblown webs. In another aspect, the invention relates to a tow useful in the manufacture of filters, particularly cigarette filters. In still another aspect, the invention relates to a method for manufacturing a tow having an electrostatic charge.

BACKGROUND OF THE INVENTION

Meltblown products are a particular type of nonwoven material consisting of random collection of thermoplastic microsized fibers ranging in typical average diameters from about 1 to 15 microns. These products are available in the form of webs, cylinders, or rovings and make particularly good filters because of the small pore size in the randomly collected fibers.

Cigarette filters made from meltblown nonwovens, however, have not been particularly successful. It has been difficult to produce the nonwovens in the small cylindrical shape necessary for cigarette filters with the desired physical characteristics such as filterability and hardness. Filter production using meltblown web is presently limited by the small lengths of the web which can be packaged for a batch. Also rods from meltblown web are soft and have end recess.

U.S. Pat. No. 3,595,245 discloses a polypropylene meltblown cigarette filter. This filter is in the form of a roving produced by a circular meltblowing die. The circular die is expensive and difficult to operate. Moreover, they have not consistently produced filters of the quality necessary for cigarette filters. For these reasons, the cigarette filters of meltblown rovings manufactured from circular dies have not received notable commercial use.

There have been efforts to produce cigarette filters from nonwoven materials in addition to meltblown rovings. U.S. Pat. No. 3,346,682 discloses a cigarette filter made from a thin polymer sheet. The sheet is calendered and slit into tapes; each tape then is bulked and collected in a form suitable for cigarette filters.

U.S. Pat. No. 3,888,610 discloses a method of forming nonwoven rovings useful as cigarette filters. These rovings are produced from individual nozzles.

U.S. Pat. No. 4,059,121 discloses a small disc section of a filter packed with a mass of nonwoven polymeric fibers.

Canadian Patent 841,368 discloses a cigarette filter made from acrylonitrile microfibers. The fibers are made by evaporation of a solvent of an acrylonitrile solution and coagulating the polymer.

U.S. Pat. Nos. 3,444,863 and 3,704,192 disclose spray spun filaments which are useful as cigarette filters. These filaments have diameters ranging from 10 to 60 microns and rely on the large diameter variations in the filaments to achieve air permeability.

U.S. Pat. No. 4,579,130 discloses a molten blend of two thermoplastics are extruded into fibers which are then twisted and/or crimped. The twisted fibers are then formed into a filter rod.

European Patent Application No. 88103071.2 (Publication No. 0330709) and Taiwan Patent Application No. 77106568 each discloses the use of meltblown web as a cigarette filter. The meltblown web is not drawn under heated conditions in the conversion from web to rod, but is merely pulled through a garniture.

U.S. Pat. No. 4,189,511 discloses a filter which utilizes a fragment of ruptured film in a fibrous matrix to achieve the balance between pressure drop and filterability.

U.S. Pat. No. 5,025,815 discloses a cigarette filter tow which includes fibrillating the tow to achieve filter bulking.

Many of the above patents, particularly U.S. Pat. No. 4,189,511, address the problem of balanced filterability and pressure drop. For example, a very tight filter will provide effective filtration at relatively high pressure drop, making it difficult for the smoker to suck the smoke therethrough. Thus, a cigarette filter must exhibit effective filterability at relatively low pressure drop.

SUMMARY OF THE INVENTION

The process of the present invention produces a tow capable of being processed through conventional equipment in the manufacture of cigarette filters. Briefly, the process comprises the following steps:

(a) selecting a thermoplastic meltblown web having longitudinally extending and transversely spaced bend lines formed thereon;

(b) drawing the web under heat to cause the web to (i) longitudinally stretch, (ii) develop longitudinally extending micropleats generally at the bend lines, and (iii) transversely contracting the web thereby forming a tow; and (c) cooling the tow, preferably under tension.

The tow can be collected in a container for later processing, or alternatively, it can be further processed in-line to form a rod filter.

The tow is flexible, durable and sturdy, making it easily packed at high densities and processable at high rates. In processing the tow into cigarette filters, the tow may be used with conventional cigarette filter manufacturing equipment (e.g. garniture or trumpet).

The tow, because of its unique properties, can be used in virtually any type of rod forming apparatus, including the S-type folding technology used by DeCoufle.

In a one embodiment, the tow is further drawn upstream of the garniture (or trumpet) under heat to impart the desired physical characteristics to the filter rod being made from the tow. Thus, the tow in this embodiment, is delivered to the cigarette filter manufacturing line in only partially drawn state so that the final drawing at the line can adapt the tow to the requirements of that line and its product. Initial hot drawing is desirable to allow tow packaging at high packing factors (densities) and high speed final processing into filter rods.

In a particularly preferred embodiment, the tow has an electrostatic charge imparted thereto. The method for electrostatically charging tow is carried out preferably at a warm or elevated temperature (i.e. before the tow has cooled appreciably from the heating step.

The tow prepared according to the present invention is characterized by the following properties: flexible and sturdy, easily packed at high densities, easily processed through conventional rod forming lines. The rods or filters made from the tow exhibit exceptional hardness (vis-a-vis other rods and filters) and exceptional filtration, particularly with electrostatic charge imparted thereto.

BRIEF DESCRIPTION OF DRAWINGS

FIG. 1 is a perspective view of a meltblown web useable in the present invention, schematically illustrating longitudinal bend lines in the web.

FIG. 2 is a longitudinal sectional view of a collector screen used in meltblowing lines to collect meltblown fibers and form a web.

FIG. 3 is a view similar to FIG. 1 illustrating another pattern of bend lines angled relative to MD.

DESCRIPTION OF PREFERRED EMBODIMENTS

Figure 4:
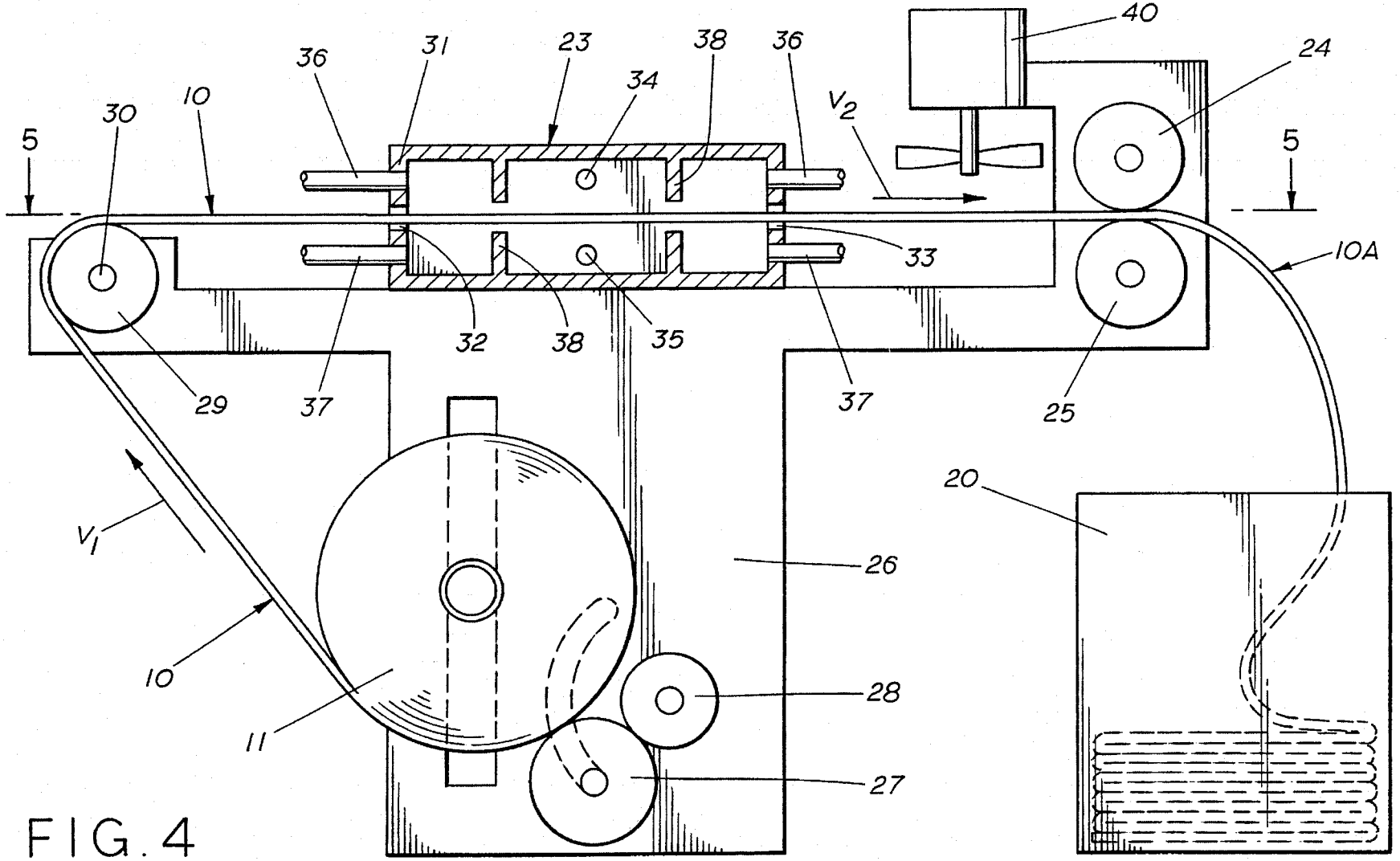
FIG. 4 is a side elevation of apparatus for forming tow from a meltblown web.

In accordance with a preferred embodiment, the method of the present invention involves drawing a meltblown web under thermal conditions to cause the formation of micropleats and impart a set thereto. The micropleated tow then may be stored for later processing into cigarette filters, or processed in-line through conventional rod forming equipment.

Prior to processing through the conventional cigarette filter line, or simultaneous therewith, the process in one embodiment of the present invention permits additional drawing of the tow to achieve the desired properties of the filter such as pressure drop per filter plug diameter.

In its broadest aspect, the process for forming cigarette filters comprises: (a) partially or fully drawing a nonwoven web under thermal conditions to form a tow; and (b) passing the drawn tow through a cigarette filter or rod forming line to form a filter or filter rod. In the case of the partially drawn tow, it may be further drawn in processing to form the rod to "fine tune" the tow to the requirements of the line employed.

As mentioned above, the partially or fully drawn web is preferably processed through an electric field to impart an electrostatic charge to the fibers thereof, prior to converting the web into a rod.

In order to produce the tow of suitable properties for storage and later processing, it is essential that the precursor web have certain properties and that the process be carried out under controlled conditions. These important aspects, including electrostatic charging, of the invention are described below.

Precursor Web

The precursor meltblown web is produced by the meltblowing process which involves extruding a thermoplastic resin through a series of aligned and closely spaced orifices to form a row of filaments while sheets of hot air contact the filaments on both sides and impart drag forces thereto to drawn down the filaments to microsize (e.g. 1 to 15 microns in average diameter, preferably 2–12 microns), most preferably 3 to 10 microns. The filaments are collected on a moving collector to form an integrated web of randomly entangled fibers. The fibers may also exhibit some contact bonding that adds strength to the web. The apparatus and process for manufacturing of meltblown webs are disclosed at length in the published literature, including U.S. Pat. Nos. 4,818,463 and 3,978,185, the disclosures of which are incorporated herein by reference. The terms "filaments" and "fibers" are used interchangeably herein.)

The thermoplastic resins used to make the precursor web may include the following: polyolefins (including polyethylene, polypropylene, copolymers and terpolymers thereof), polyesters, nylon, EVA, elastomers, polyamides, polystyrene, polytrifluorochloroethylene, and blends of these. The preferred resin are the polyolefins, including homopolymers and copolymers of the family of polypropylenes, polyethylenes and higher polyolefins. The most preferred resins are the homopolymers and copolymers of ethylene and propylene. Polyethylenes include LDPE, HDPE, LLDPE, and very low density polyethylene. Polypropylene is the most common resin used in meltblowing. The MFR and MW of the meltblowing resins are well known to those skilled in the art. Polypropylene and propylene copolymers having an MFR of 35 (based on 2.7 kg at 230° C.) are particularly suited for use in the present invention.

The precursor web for use in the present invention preferably has the following properties for a nominal 8 mm diameter filter:

| | Broad Range | Preferred Range |
|---|---|---|
| Basis weight, oz/yd$^2$ | 0.22–0.57 | 0.3–0.45 |
| Thickness, mills | 1–15 | 3–8 |
| Elongation at break, % | 1–10 | 2–5 |
| Bend lines (no. per inch) | 10–50 | 15–35 |
| Total width (inch) | 10–60 | 20–40 |

The properties described above are conventional properties for meltblown webs except for the bend lines. The term "bend lines" as used herein means lines or narrow sections which extend longitudinally along the length of the web (or have a longitudinal component) and predetermine the positions of the micropleats which are formed attendant to the drawing step described below.

As shown in FIG. 1, a nonwoven web 10 dispensed from roll 11 (or directly from a meltblowing die, not shown) includes a plurality of closely spaced bend lines shown by dotted lines 12. The number of bend lines 12 can vary within a wide range and will depend on several factors, but preferably from 15 to 30 bend lines per inch of web width are provided.

The bend lines 12 can be imposed on the web 10 by scoring or by indentations or other mechanical means for imparting a weakness or a thin section in the web 10 to induce bending at predetermined locations to form the micropleats. Preferably, however, the bend lines 12 are formed during web production by the shape and construction of the surface of the collector used to collect and form the arriving fibers into the web.

With reference to FIG. 2, a collector 13 is shown to include a rotating screen 14 mounted on end members 15 and 16. The screen 14 has circumferential extending wires 17 woven through transverse wires 18. As the web 10 is deposited on the screen 14, air 19 passes through the screen 14 and exits through end members as illustrated by 20. The air usually is withdrawn by a vacuum so that the web 10 is somewhat compressed on the screen 14. The web 10 conforms to the topography of the screen 14 in the form of alternating peaks (as at 21) and valleys (as at 22). These peaks and valleys remain to some degree in the web 10 even after it is withdrawn from the collector and rolled in the form of roll 11. The peaks and valleys 21 and 22 determine the locations of various bend lines 12 as illustrated in FIG. 2. Note that there will be twice the number of bend lines 12 as peaks 21 illustrated in FIG. 2, because the peaks and valleys will be reversed for the adjacent wires 17. As in conventional screens, the undulating circumferential wires 17 woven through the transverse wires 18 will alternately pass over and under adjacent transverse wires 18. Adjacent wires 17 will be on opposite sides of a particular transverse wire 18.

The typical screen 14 has from 15 to 35 circumferential wires 17 per inch and from 5 to 30 transverse wires 17 per inch. The wires typically have a diameter from 0.005 to 0.020 inches. Although the bend lines 12 produced by the typical collector screen 14 may not be readily apparent to the eye, they nevertheless are present and determine location of the bend lines for the formation of the micropleats as described below.

A variation in the location of the bend lines 12 may include the use of spiral angularly disposed wires or means to form the bend lines 12 to dispose the bend lines 12 at an angle as shown in FIG. 3. These bend lines 12, however, have a major direction component in the machine direction of the web 10. The angle at which the bend lines 12 in FIG. 3 forms with the longitudinal axis of the web 10 preferably should be from 0 to 10 degrees.

Producing the Tow

The tow may be produced by drawing the web 10 under thermal conditions to form micropleats and imparting a heat set to the micropleats. As described in detail below, the apparatus for transforming the web 10 into tow 10A includes: (a) means for dispensing the nonwoven web 10 in a generally planar disposition, (b) a heater for heating an intermediate portion of the web, and (c) means for drawing the web through the heater. The tow 10A may be discharged into a container such as a compactable bale for storage and/or transport. Alternatively, the tow 10A may be processed directly into a rod or filter rod by in-line rod forming or filter forming apparatus.

As illustrated in FIG. 4, a nonwoven roll 11 is mounted on apparatus frame 26 by means of idler roller 27 and driver roller 28. The idler roller 27 bears against the lower surface of the roll 11. A variable speed electric motor with suitable gear reduction means (not shown) drives roller 28 which in turn drives roller 27 and controls the rotation of roll 11, and hence the feed rate of web 10 dispensed from web roll 11. The web 10 is dispensed from the roll 11 and extends around idler roller 29 which has its opposite ends journaled to frame 26 by shaft 30. The web 10 extends around the idler roller 29, through heater 23 and through the nip of counterrotating rollers 24 and 25. One of the counterrotating rollers 24 and 25 may be driven to pull the web 10 from the roll 11 around the idler roller 29 and through the heater 23. As illustrated, the frame 26 supports the various components of the apparatus.

The heater 23 includes a housing 31 having a slotted opening inlet 32 and a slotted outlet 33 through which the web 10 passes. Hot air inlets 34 and 35 above and below the web 10, and air outlets 36 and 37 conduct hot air into contact with the web 10. Hot air thus heats both sides of the web 10. The temperature of the web 10 in the oven will depend upon the thermoplastic employed. Temperature equal to or above the softening temperature of the thermoplastic are necessary, but should not exceed a temperature at which the web integrity cannot be maintained. The upper limit of the web temperature is at least 5° C., and preferably 10° C., below the melting point of the thermoplastic employed. Internal baffles 38 may also be provided in the heater 23 to ensure distribution of the hot air within housing 31 to achieve uniformity in web drawing. An air fan 40 positioned above the web 10 and immediately after the heater outlet 33 serves to cool the web.

Figure 5:
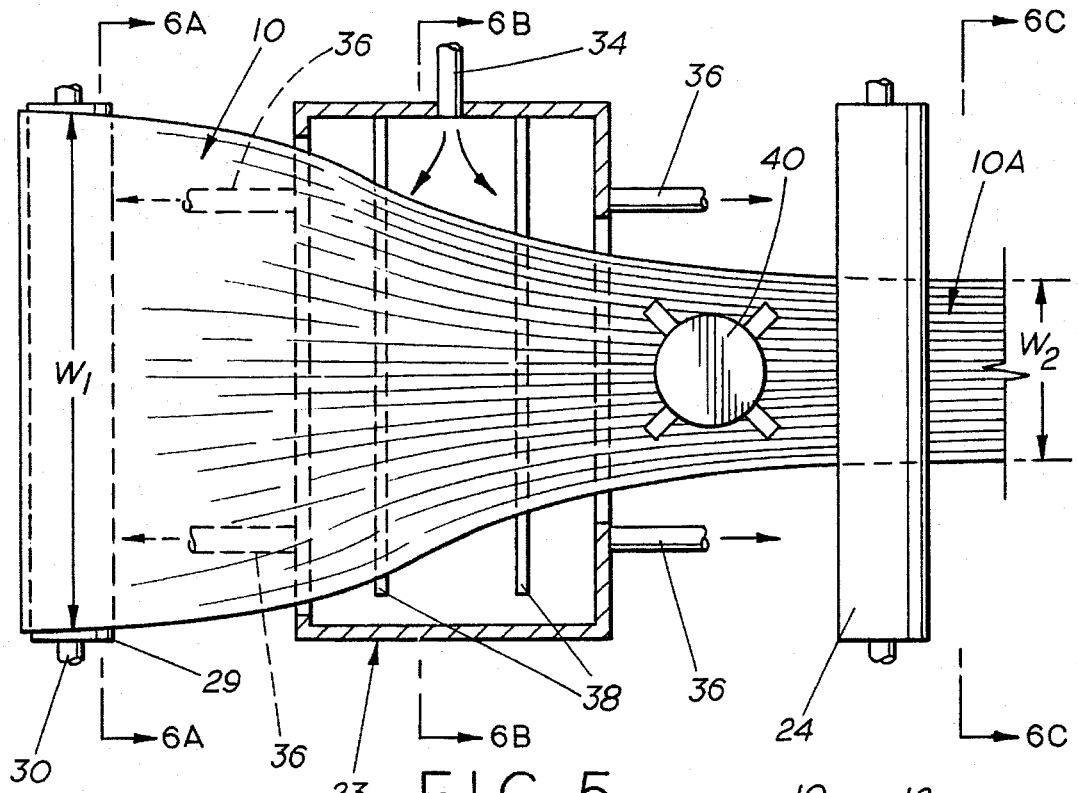
FIG. 5 is a top plan view of the apparatus shown in FIG. 4.

FIG. 5 illustrates the disposition of the web 10 in plan view as it is dispensed over roller 29 and is drawn through the heater 23 by the action of the counterrotating rollers 24 and 25. The evolvement of the micropleats from the web 10 as the web passes through the oven is illustrated in FIGS. 6A, 6B and 6C, which are cross-sectional views of the web 10 at 6A, 6B, and 6C in FIG. 5.

Figure 6A:
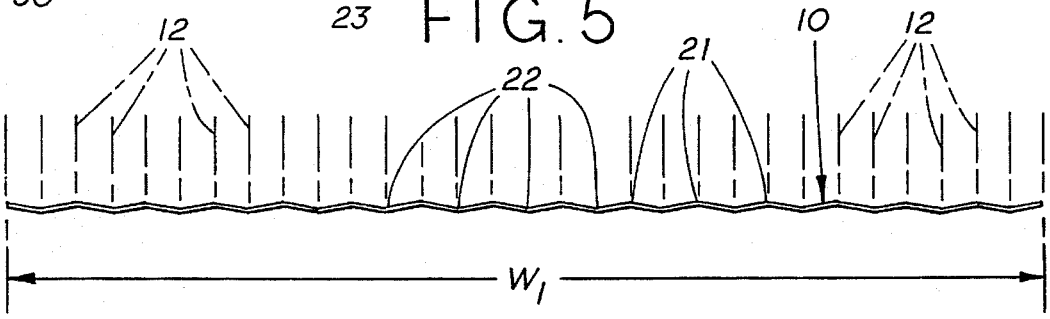
FIGS. 6A, 6B, and 6C are sequential cross-sectional views of the web passing through the apparatus in FIGS. 4 and 5, illustrating the micropleating sequence as the web is drawn under heat.
Figure 6B:
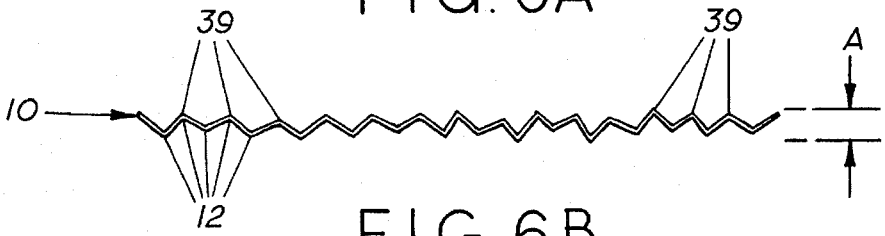
Figure 6C:
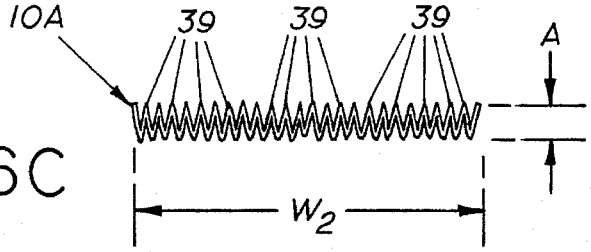

As shown in FIG. 6A, the web 10 upon passing over roller 29 is substantially flat, but as described earlier does have the bend lines 12 (e.g. indentations imposed on the web by the screen wires), determined by the peaks 21 and valleys 22 of the undulating web 10. As the web 10 is pulled through the heater 23, a draw is imparted thereto by driving the counterrotating rollers 24 and 25 at a speed ($V_2$) in excess of the web dispensed from roll 11 ($V_1$). The heat applied to the web in heater 23 causes the thermoplastic fibers to soften. This, coupled with the drawing action, causes the web 10 to contract laterally and form micropleats 39 (bending along the bend lines 12) as illustrated in FIG. 6B. The micropleats 39 will have an amplitude of about 1.2 to 2.0 times the thickness of the web 10 and initially will be separated from peak to peak by a distance less than the separation of the bend lines 12 as shown in FIG. 6A. However, with continued drawing as the web 10 passes through the heater 23, the width of the web 10 narrows as illustrated in FIGS. 6B and 6C and the micropleats 39 are compressed together much in the manner of a closing accordion bellows. The final micropleated web 10A preferably will have from 20 to 100 pleats per inch.

The compressed web with the micropleats 39 formed therein exiting heater 23 may be cooled by a fan 40 (FIG. 4) or merely permitted to cool, thereby imparting a set to the micropleats 39 forming the tow 10A. The final micropleats 39 have an amplitude (a) from 1.2 to 10 times, preferably 1.2 to 5, most preferably 1.5 to 5 times the thickness of the web 10. The tow 10A, upon passing the nip of the counterrotating rollers 24 and 25, may be processed in line further, or directed into a container 20 where the tow is layered and prepared for compaction, storage and transportation. Tow 10A is flexible, strong, durable and sturdy, permitting it to be handled and packed in the container 20. The disposition of the tow packed in this container will generally be in a first in-last out format with random fan folding of the tow in the container.

It should be noted that the draw ratio ($V_2/V_1$) causes the web 10 to narrow and induces the formation of micropleats 39. Some fiber orientation and fiber stretching in the MD may also take place thereby enhancing the (MD) tenacity of the tow. This factor makes it possible to utilize the tow in bale form and at high speeds.

The tow 10A is characterized by the following properties:

MD Tenacity improvement over base web: ≧50%

Bulk density improvement over base web: ≧50%

Elongation at break: 1–5%

The process for manufacturing the tow 10A includes several variables, the most important of which are listed below with broad, preferred, and most preferred ranges:

| | Broad Range | Preferred Range | Most Preferred Range |
|---|---|---|---|
| Draw ratio ($V_1/V_2$) | 1.1–3.0 | 1.2–2.0 | 1.3–1.6 |
| Air temperature, °C. | 90–160 | 120–150 | 135–145 |
| Width ratio $W_1/W_2$ | 1.15:1–4:1 | 1.3:1 to 3:1 | 1.6:1–2.5:1 |

It should be noted that the combination of air temperature and residence time in the heater 23 and heater design affect web temperature. The temperature of the web at heater exit, however, generally will be 0° to 5° C. below the heater temperature.

The final product is a full or partially drawn tow which not only is easily packed, stored and handled, but is readily adapted to conventional cigarette filter forming equipment as described below.

Processing Tow into Cigarette Filters

As mentioned previously, a particularly advantageous feature of the fully-drawn tow manufactured in accordance with the present invention is that it permits the tow to be processed using conventional cigarette filter or rod forming equipment. Alternatively, the tow may be only partially drawn, permitting a secondary drawing or "fine tuning" of the web to achieve the desired specifications for converting the tow to a filter or filter rod. In practice, the tow 10A can be manufactured at one location, either in line with a meltblowing line or separately using meltblown rolled web as described above. The tow 10A then can be stored and transported to a different location for processing through the cigarette filter manufacturing equipment.

When processing the partially drawn tow, the line includes means for further drawing the tow 10A and converting it into a cigarette filter or rod. This process may be carried out by the apparatus shown in FIGS. 7 and 8. As illustrated, the partially drawn and pleated tow 10A in container 20 is withdrawn and fed through counterrotating rollers 41 and 42, heater 43, second counterrotating rollers 44 and 45, and into a trumpet or garniture 46. A web cooling fan 58 can be used between heater 43 and nips 44 and 45. The tow 10A is fed through the nip of counterrotating rollers 41 and 42, and disposed in generally a plainer condition wherein the micropleats are disposed in a side-by-side relationship. The heater 43 may be of the same general construction as hot air heater 23 having air inlets 47 and air outlets 48. The tow 10A passes through the nip of counterrotating rollers 44 and 45 generally in the plainer condition. The tow 10A from the nip of the counterrotating rollers 44 and 45 converge into the restriction 49 (e.g. a trumpet or garniture) and is discharged as a rod or a filter 10B. Rotating belts or rollers acting on the rod 10B are used to pull the tow through the trumpet or garniture 49. Between the nip of counterrotating rollers 44 and 45 and the garniture, the web is laterally compressed forming major pleats and micropleats much in the manner as described in U.S. Pat. No. 5,053,066 by the same inventor.

Figure 7:
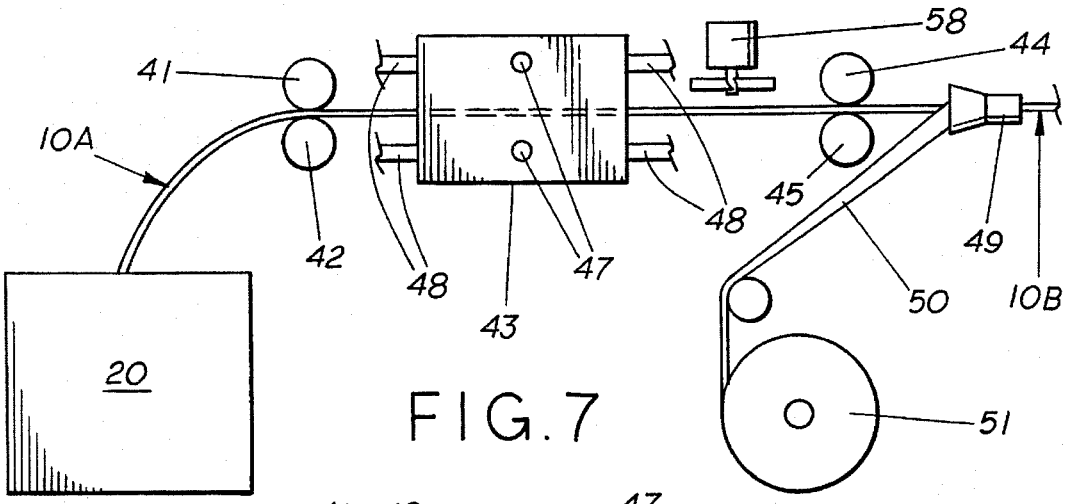
FIG. 7 is a simplified, side elevational view of a cigarette forming line illustrating the processing of the tow into a cigarette filter or filter rod.
Figure 8:
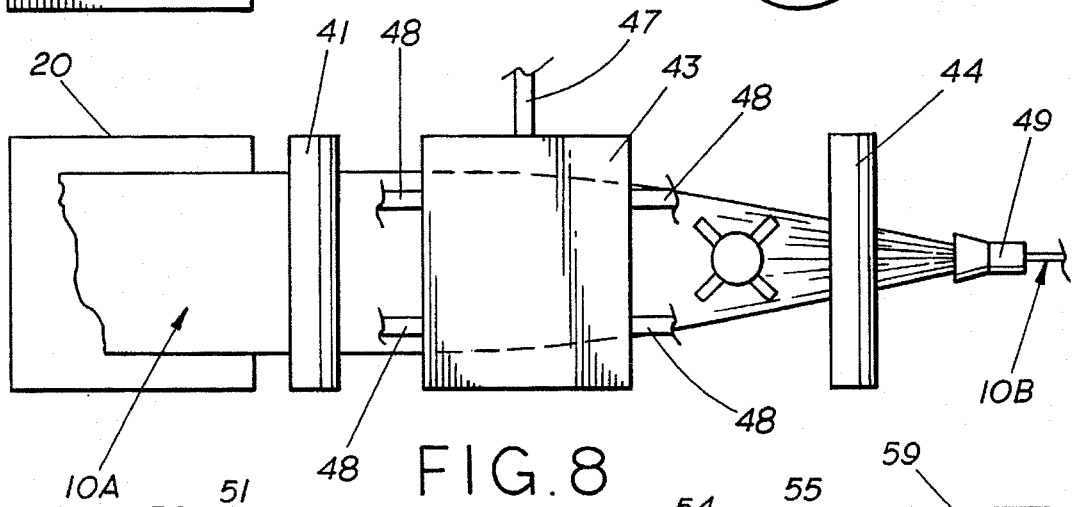
FIG. 8 is a top plan view of the line shown in FIG. 7.

Variables in the process depicted in FIGS. 7 and 8 include the velocity ($V_1$) of the tow 10A passing the nip of counterrotating rollers 41 and 42, the velocity ($V_2$) of the tow passing the nip of counterrotating rollers 44 and 45, and the air temperature in the heater 43.

The velocity ratio ($V_2/V_1$) determines additional draw imposed on the tow 10A. This, of course, will depend upon several factors but generally from 10 to 50% of the total draw on the tow should occur at this stage of the operation. Thus if the draw ratio of the tow imposed by the partial drawing in forming two 10A is from 1.20 to 1.5, the additional draw imposed in heater 43 should be from 1.02 to 1.5. The heater 43 should heat the tow 10A to a temperature equal to or above the softening temperature of the thermoplastic.

In the embodiment wherein a garniture 49 is used, paper 50 dispensed from roll 51 is fed into the garniture 49 and used to cover the cigarette filter in the conventional manner.

Figure 11:
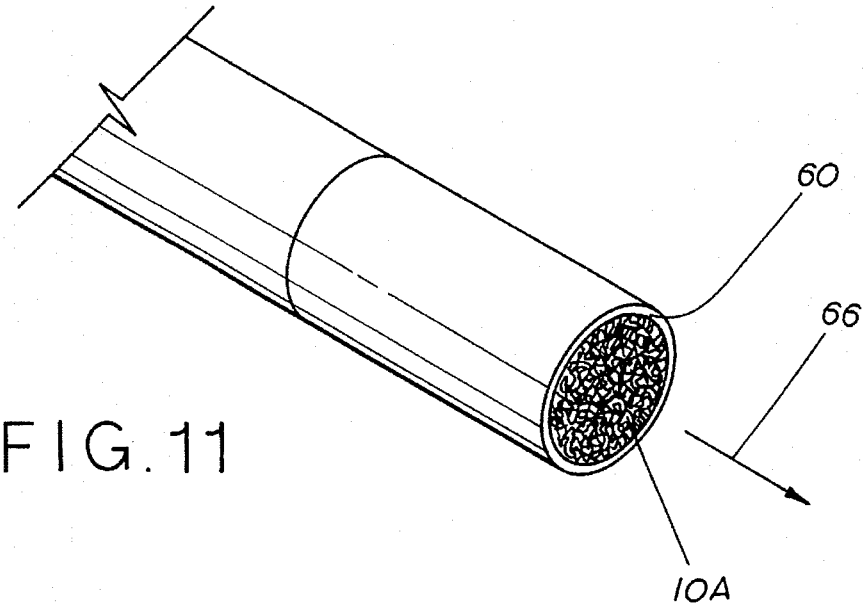
FIG. 11 is a perspective view of a cigarette filter manufactured according to the present invention.

The final cigarette filter, whether in the rod form or coated with the paper, comprises a bundle of random pleats formed from nonwoven web into a rod or paper-wrapped filter. The pleats are randomly bundled to form the cylinder and extend generally longitudinal with respect to the cylinder axis. The shape of the pleats and the arrangements of the fibers therein due to the bulking provide the necessary balance of filtration and pressure drop and hardness. It should be noted that although smoke constituents can diffuse into the bulked web roving, the air flow through the filter is generally parallel to the longitudinally extending pleats. The micropleats add bulk to the web thereby providing the flow courses for the cigarette smoke in passing longitudinally through the filter. FIG. 11 illustrates a cigarette filter formed from the tow prepared in accordance with the present invention.

Alternative filter rod manufacturing machines, such as the "S fold" technology, can also utilize the tow 10A in the steps of (a) spreading the tow, (b) fan folding the tow in an orderly longitudinal manner to form layers, then (c) "S" folding the fan folded stack prior to being fed into a garniture for cylindrical formation and paper wrapping. For such "S" folded filters, layers of the micropleated tow are superimposed (stacked) in an ordered manner and the micropleats provide the generally axial flow channels through the filter rod.

Alternate Embodiments

In lieu of using a precursor web from a roll, the precursor web can be withdrawn directly from the meltblowing collector and process as described above.

Figure 9:
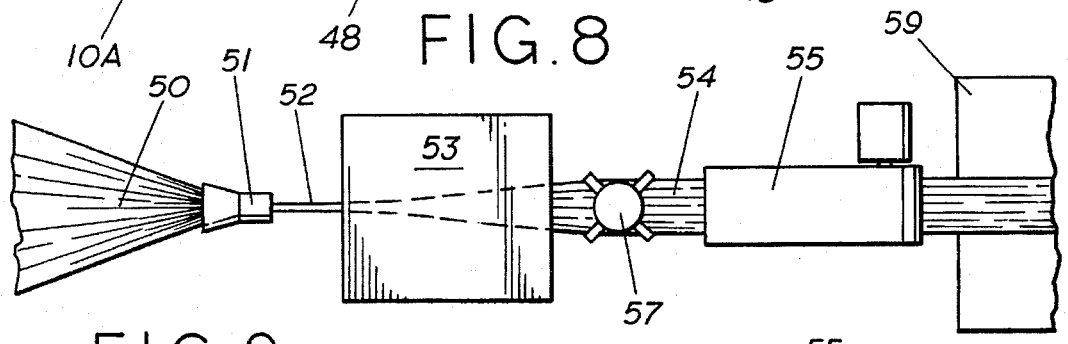
FIG. 9 is a top plan view of a line for processing fully drawn tow from a meltblown web.
Figure 10:
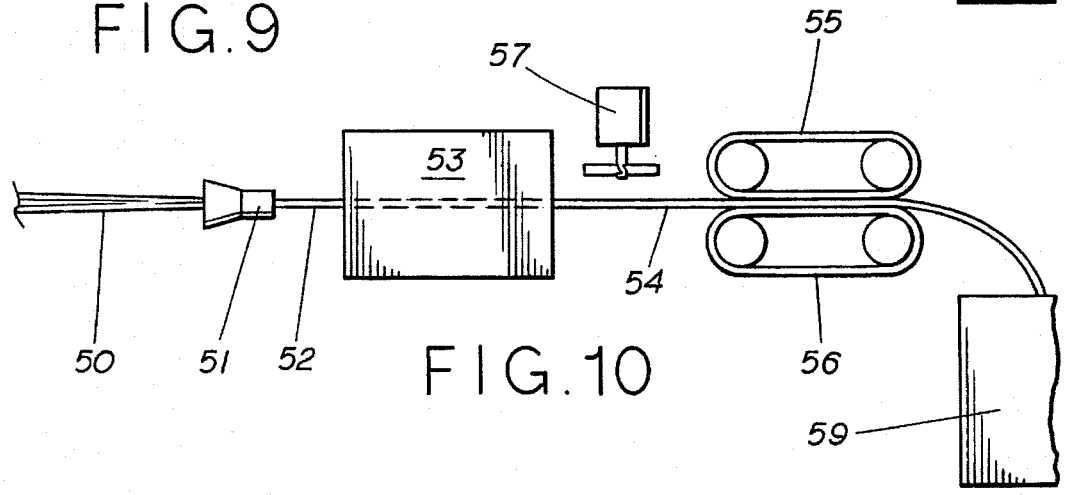
FIG. 10 is a side elevation of the line shown in FIG. 9.

Another embodiment for manufacturing tow from nonwoven meltblown webs which are suitable for conventional cigarette filter equipment includes producing a filter rod in accordance with the process described in U.S. Pat. No. 5,053,066, the disclosure of which is incorporated herein by reference, and thereafter spreading the rod to form a loose tow which is cooled. This process may be carried out by the apparatus shown in FIGS. 9 and 10. As illustrated, a web 50 is pulled through a trumpet 51 in the manner described by U.S. Pat. No. 5,053,066 forming the cigarette filter rod 52. The rod 52 is then passed through a spreader 53 which spreads the rods into a loosely bundled web 54. The rod 52 and the web 54 may be pulled through the trumpet 51 and spreader 53 by the use of counterrotating belts 55 and 56. The tow 10A, upon leaving the spreader 53, may be cooled by fan 57. The tow 54 then is fed from the counterrotating belts 55 and 56 into container 58 for storage and transportation. The tow can be processed directly into the garniture of a conventional cigarette filter line as described above. The spread tow retains the bend lines which were imposed by the upstream processing so that in being processed through the garniture, the micropleat structure will be repeated forming a filter similar to that shown in FIG. 11, which comprises bundled tow 10A wrapped with paper 60. In fact, regardless of the process used in converting the tow 10A to a filter, the final cigarette filter will be generally as depicted in FIG. 11 where the micropleats extend generally in the direction of smoke movement as illustrated by arrow 66.

The spreader 53 may be an air spreader in which the air entering a small gap containing the tow forces the tow into a general planner configuration.

Another embodiment involves processing of the filter rod 52 as a separate step. For example, a filter rod can be manufactured in accordance with the process of U.S. Pat. No. 5,053,066 and stored in a container. At a later time and on a separate line the filter rod 52 can be converted to tow by passing the tow through the spreader 53 and processed directly through the cigarette filter manufacturing equipment, or stored in container 59 for later processing.

Electrostatic Charging

Another preferred embodiment involves the use of charging apparatus to impart an electrostatic charge to the tow 10A thereby producing an electret. Electrets maintain electrical charges in polymeric constituents which generate permanent electric field about the fibers.

Figure 12:
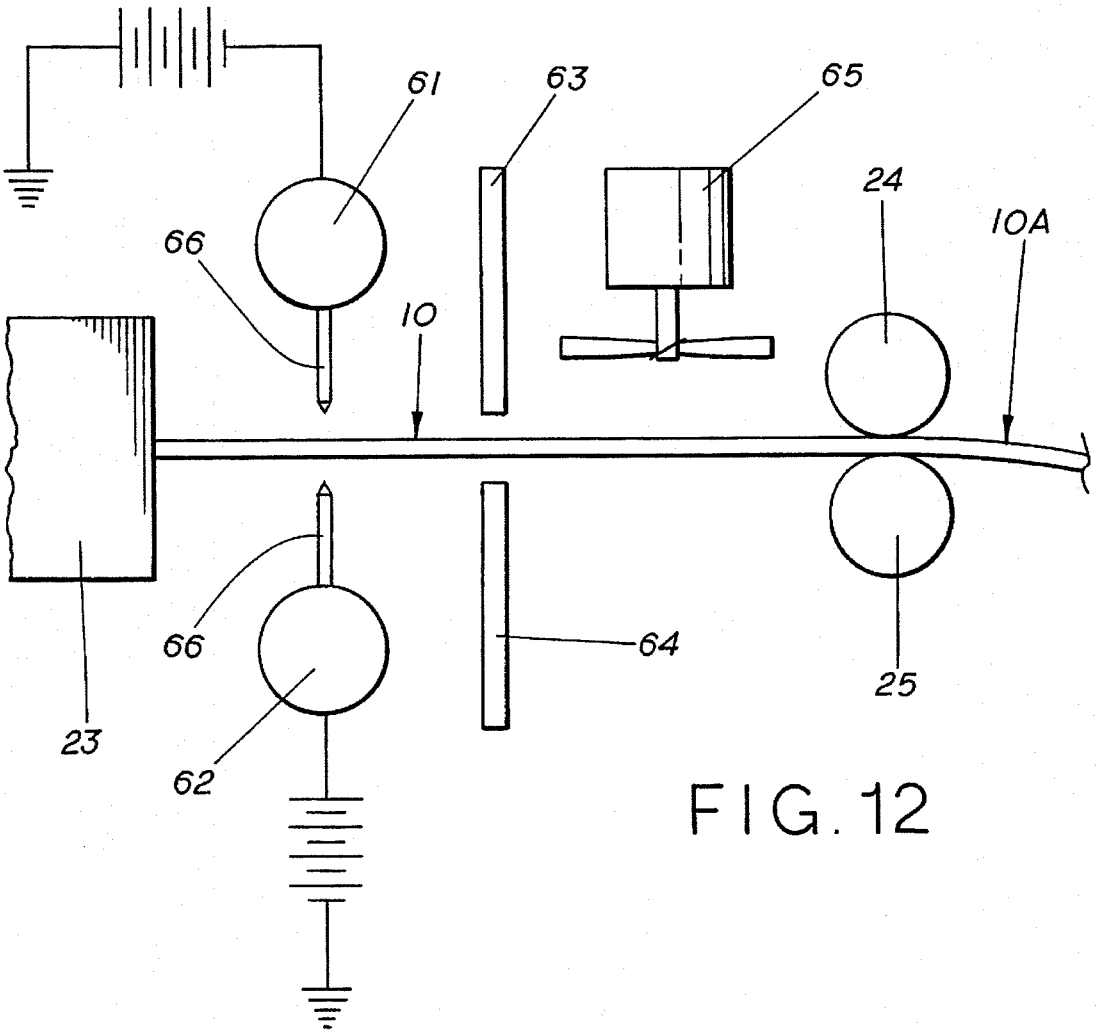
FIG. 12 is a side elevation illustrating electrostatic charging of a meltblown tow.

The apparatus in the form of charging electrodes 61 and 62 may be positioned at the exit of heater 23 (or 43) as schematically illustrated in FIG. 12. The electrodes 61 and 62 carry D.C. voltages of from about 1 KVDC to about 5 KVDC per cm of electrode separation and may be the same or opposite polarity. The electrodes may be in the form of elongate metal bars having a diameter having a series of points 66 spaced therealong and extend across the full width of the web 10. It is preferred that the electrodes 61 and 62 are spaced above and below the web 10 by at least ¼ inches and preferably between ½ to 3 inches. For most applications the voltage source for each electrode may be between 5 to 25 KV. A high voltage power source marketed by SIMCO, of Hatfield, Pa., serves as an adequate power source. A curtain or wall 63 and 64 may be provided to separate the charging zone from the cooling zone of the line.

A fan 65 may be employed to cool the web between the charging zone and the rollers 24 and 25.

Novel features of the charging process contemplated by the present invention are the charging of a heat stretched meltblown web and the charging may be done by electrodes which do not contact the web. It is preferred also that the charging be carried out under stress (e.g. prior to passing the nip of counterrotating rollers 24 and 25).

The charging of the web is done with the web still hot or at least warm (i.e. at a temperature from 5° C. to 50° C. below the web temperature in the heater 23, preferably 10° C. to 40° C. therebelow). The web temperature should be at least 110° C.

In one example, tow 10 emerging from heater 23 at a temperature of about 125° C. was charged by a 5 KVDC/CM electric field and was formed into a rod and quickly cooled to below 70° C. The charged tow within the rod increased the filtration efficiency by 35% over uncharged meltblown filters, and 131% over domestic ultralight cellulose acetate filters. After eleven months in storage, this tow had a 0.1 micometer diameter NaCl penetration measure of 71% compared to 91% for the uncharged tow. Charge stability of the tow to moisture was determined by immersing the tow in boiling distilled water containing a wetting agent for one minute. The dried samples had particulate penetration values of 69% for the charged filter rod and 88% for the uncharged rod.

Tests have shown that the effects of heat on the charging of propylene homo and copolymer webs is pronounced. The web is heated to between 110° to 165° C., and most preferably between 135° and 150° C., and then passed through an electric field which can be as described above.

EXAMPLES

A precursor web having the following properties was selected

| | |
|---|---|
| Thermoplastic | PP |
| Avg. fiber diameter | 4.5 microns |
| basis weight | 0.38 oz/yd$^2$ |
| thickness | 5 mils |
| width | 33 inches |

The precursor web was hot drawn in accordance with one aspect of the present invention to form a tow. The process conditions were as follows:

| | |
|---|---|
| $V_2/V_1$ | 1.40 |
| Oven Temp, °C. | 145 |
| Width of tow, inches | 18 |
| Charging bars, separation (cm.) | 5 (SIMCO) |
| Polarity, top/bottom | − + |
| Voltage (DC) | 15KV/15KV |

The tow was then passed through a conventional cigarette filter forming machine (type: Molins, PMII) forming a paper wrapped filter rod. The rod was cut in lengths of 1 inch and tested by measuring the weight of total particulate captured.

The average results of the tests (three for each sample) are as follows. In one sample, the tow was charged as described above and a second sample was not charged.

| | Filter Efficiency (%) |
|---|---|
| Uncharged filter | 56.7 |
| Charged filter | 76.3 |

Other tests revealed that charging the drawn web under warm conditions (i.e. before the web cooled down to room temperature from the oven) increased the effect of the charge not only on filtration efficiency, but also on charge retention time.

Although the reasons for the improved charging results with heated webs is not fully understood, it is believed that the hot or warm fibers permit deep penetration of the electrons in the electric field into the fibers, and upon cooling the electrons are captured in the fiber molecular structure. This appears to be particularly true for PP.

What is claimed is:

1. A process for manufacturing a pleated web suitable for the manufacture of cigarette filters which comprises:

(a) selecting a nonwoven web having from 10 to 50 bend lines per inch extending generally in the MD and spaced transversely across the web, (b) heating the web to a temperature equal to or greater than the softening temperature of the polymer while drawing the web in the MD by at least 10% to cause micropleats to form at the bend lines, thereby reducing the width of the web by at least 15% and condensing the micropleats thereby forming a pleated web; and (c) cooling the tow pleated web.

2. The process of claim 1 wherein the nonwoven web is a meltblown web composed of entangled fibers having an average diameter of from 1 to 15 microns.

3. The process of claim 2 and further comprising the step of converting the pleated web into a rod suitable for cigarette filters.

4. The process of claim 3 wherein the step of converting the pleated web into a rod comprises pulling the pleated web through a trumpet.

5. The process of claim 4 wherein the step of pulling the pleated web through a trumpet is carried out at a temperature at or above the softening temperature of the pleated web wherein additional draw in the MD is imparted to the pleated web.

6. The method of claim 5 wherein the amount of draw in step (a) represents from 20 to 50% of the total draw imparted to the pleated web.

7. The process of claim 2 wherein the drawing step is performed by stretching the web by the application of tension and wherein the cooling step is carried out with the stretched web under tension.

8. The process of claim 2 wherein the thermoplastic is a polyolefin.

9. The process of claim 8 wherein the polyolefin is a propylene copolymer or homopolymer.

10. The process of claim 2 wherein the web has the following properties:

basis weight from 0.2 to 0.45 ounces/yd$^2$, average fiber diameter from 2 to 15 micrometers.

11. The process of claim 2 wherein the bend lines form an angle of 0° to 10° with the longitudinal axis of the web.

12. The process of claim 2 wherein the web is composed of fibers having an average diameter of 3 to 10 microns.

13. The process of claim 2 and further comprising, prior to the cooling step, passing the heated web through an electric field of sufficient magnitude to impart a charge to the web.

14. The process of claim 13 wherein the temperature of the web passing through the electric field is from 0° to 50° C. below the temperature of the web heated in step (b).

15. The process of claim 14 wherein the electrostatic field is provided by spaced apart electrodes wherein the heated web is passed therebetween, each electrode being provided with a charge of ±1.0 to 5.0 KVDC per cm of separation of the electrodes.

16. A process for applying an electrostatic charge to a meltblown tow of a propylene homo or copolymer which comprises:

(a) drawing and heating the tow to a temperature between 110° C. and 165° C.; and (b) passing the drawn and heated tow through an electric field.

17. A process for manufacturing a pleated web suitable for the manufacture of cigarette filters which comprises:

(a) selecting a nonwoven web having from 10 to 50 bend lines per inch spaced transversely across the web and extending generally in the MD of the direction of the bend lines, the bend lines having a major direction component in the MD; and (b) heating the web to a temperature equal to or greater than the softening temperature of the polymer while drawing the web in the MD from 10 to 300% to cause micropleats to form at the bend lines, thereby reducing the width of the web in a ratio of the micropleated web width to original web width of 1.15:1 to 4:1.

18. The process of claim 1 wherein the micropleated web has from 20 to 100 micropleats per inch.

* * * * *